US005259279A

United States Patent [19]

Strauch

[11] Patent Number: 5,259,279

[45] Date of Patent: Nov. 9, 1993

[54] SLOT SCREWDRIVER

[75] Inventor: Martin Strauch, Wuppertal, Fed. Rep. of Germany

[73] Assignee: Wera Werk Hermann Werner GmbH & Co., Wuppertal, Fed. Rep. of Germany

[21] Appl. No.: 869,780

[22] Filed: Apr. 16, 1992

[30] Foreign Application Priority Data

May 2, 1991 [DE] Fed. Rep. of Germany ..... 9105418

[51] Int. Cl.[5] ..... B25B 13/48

[52] U.S. Cl. ..... 81/436; 81/460; 81/900

[58] Field of Search ..... 81/436, 460, 900, 488; 7/165

[56] References Cited

U.S. PATENT DOCUMENTS

| | | | |
|---|---|---|---|
| 2,193,477 | 3/1940 | De Vellier | 81/436 |
| 3,013,929 | 12/1961 | Reiling | 81/488 |
| 3,120,251 | 2/1964 | York | 81/436 |
| 3,592,247 | 7/1971 | Solf | 81/177.1 |
| 4,016,912 | 4/1977 | St-Amour . | |
| 4,625,598 | 12/1986 | Wolfram . | |
| 4,938,731 | 7/1990 | Nguyen et al. | 81/460 |
| 5,001,948 | 3/1991 | Weible et al. | 81/436 |

FOREIGN PATENT DOCUMENTS

| | | | |
|---|---|---|---|
| 1272847 | 7/1968 | Fed. Rep. of Germany . | |
| 3206494 | 9/1983 | Fed. Rep. of Germany . | |
| 8519877 | 10/1985 | Fed. Rep. of Germany . | |
| 2063743 | 6/1981 | United Kingdom | 81/900 |

*Primary Examiner*—James G. Smith
*Attorney, Agent, or Firm*—Martin A. Farber

[57] ABSTRACT

A slot screwdriver with convex wide-side surfaces of the blade (3, 19) on its working end (8, 20) and, in order to optimize the use thereof, it proposes that the convexity be formed of two convex arcs (10, 21) present on each wide-side surface and lying symmetrically on both sides of the transverse center plane (A—A) of the blade (3, 19).

10 Claims, 4 Drawing Sheets

SLOT SCREWDRIVER

FIELD AND BACKGROUND OF THE INVENTION

The present invention relates to a slot screwdriver with convex wide-side surfaces of the blade at its working end.

Screwdrivers of this shape are known in accordance with DIN 52 64. In that case, the convexity on the surface of each wide side of the blade at its working end is formed by a convex arc the center of which lies in the transverse center plane of the blade.

SUMMARY OF THE INVENTION

The object of the present invention is so to develop a slot screwdriver of the aforementioned type in a manner simple to manufacture that, together with an increase in the torque acting on the slot screwdriver, an increase in the application surface between the working end of the blade and the screw slot is also obtained.

This object is achieved in a slot screwdriver of this wherein the convexity consists of two convex arcs (10, 21) present on each wide-side surface, the arcs lying symmetrically on both sides of the transverse center plane (A—A) of the blade (3, 19).

By this development, a slot screwdriver of increased value in use is obtained. The convexity on each wide-side surface of the blade at its working end is formed, in contradistinction to the prior art, by convex arcs which lie symmetrically on both sides of the transverse center plane of the blade. Their radius of curvature is less than that of a single convex arc, such as present in the prior art. By this development, the result is obtained that upon the placing on of the screwdriver or the entrance of the working end into the screw slot, there is initially linear contact between the diagonally opposite convex arcs and the screw slot. Upon increase of the torque, and due to the elastic deformability of the screwhead, this linear application changes into a continuously increasing application surface, so that optimal forces can be transmitted as a function of the size of the work end and of the screw. Together with the increase of the application surface between the wall of the screw slot and the convex arcs which takes place upon increase of torque, effect is also counteracted, namely, the moving or "jumping" of the blade out of the screw slot. Even if large tolerances should be present between the width of the blade on its working end and the width of the screw slot, optimally large drive surfaces are obtained, which assure a good driving of the screw. The diagonally opposite convex arcs always lead to a penetration into the material of the screw. A variant is characterized by the fact that the two convex arcs meet in a wedge which lies on the transverse center plane. The corresponding wedge angle is slightly less than 180 degrees. In this connection, the center of each convex arc lies on the mid-perpendicular of a straight line connecting the end points of the convex arc. By four such straight lines a rhombus is formed above the rhombus surfaces of which there are the convex arcs. The center of each convex arc lies on the portion of the mid-perpendicular in front of the point of intersection of the latter with the transverse center plane of the blade. Another advantageous feature is that the screwdriver tip is flattened with conically tapered side surfaces which, via approximately triangular recesses, form a parallel working end with convex arcs provided on the wide-side surfaces thereof. The free space obtained by the recesses can be advantageously used to provide the convex surfaces with a coating of diamond particles. In addition to the deforming of the screwhead as the torque becomes larger, the corresponding particles of this diamond coating also dig into the material of the wall of the screw slot, producing particularly good adherence between the working end and the screw slot. To a certain extent, the convex arcs result in a continuous rolling of the coating of diamond particles into the wall of the slot so that no removal effect occurs on the latter. In order to obtain a diamond coating, the work surfaces can first be provided with a metal covering, consisting of a hard base layer, for instance nickel, in a thickness within the neighborhood of 15 μm. Such a nickel layer applied by electroplating leads, in view of the hardness of nickel, to a certain reduction in wear upon the transmission of the torque and to surface protection, in particular against corrosion. This relatively hard layer of nickel serves solely for the surface application of the diamond particles which, together with an embedment layer also applied by electroplating, fixes the diamond particles in position. The coating of diamond particles on the work end has the result that the tendency of the work end to escape from the screw slot is reduced to a great extent. In addition, this coating of diamond particles increases the life of the work end of the slot screwdriver. Another version is characterized by the fact that convex arcs which are arranged on each blade wide side are connected to each other by a valley which lies between them and is of a greater length than the length of a convex arc. Therefore, the surfaces of attack which act on the screw slot are further away from the longitudinal axis of the screwdriver than in the case of the first version, so that optimum transmission of force relative to the size of the screwdriver is obtained. This is true even if play occurring in the region of the tolerances should be present between screwdriver blade and screw slot. In detail, this modified embodiment is such that the valley has a length which is a multiple of the length of a convex arc. For example, a ratio between valley and convex arc of 6:1 can be selected. In order to avoid a notch effect while increasing the stability of the screwdriver blade, the center-side end of the convex arc extends via a concave arc tangentially into the flat base of the valley. Furthermore the width of the transverse section of the blade in the region of the valley or of the wedge is about 8% less than in the region of the curvature vertex of the convex arc. The corresponding slight weakening is unimportant with respect to the transmission of force. Such a dimensioning is favorable for a coating of diamond particles which may be provided.

BRIEF DESCRIPTION OF THE DRAWINGS

Two embodiments of the invention are described below with reference to the drawing, in which.

DETAILED DESCRIPTION OF THE PREFERRED EMBODIMENTS

Figure 1:
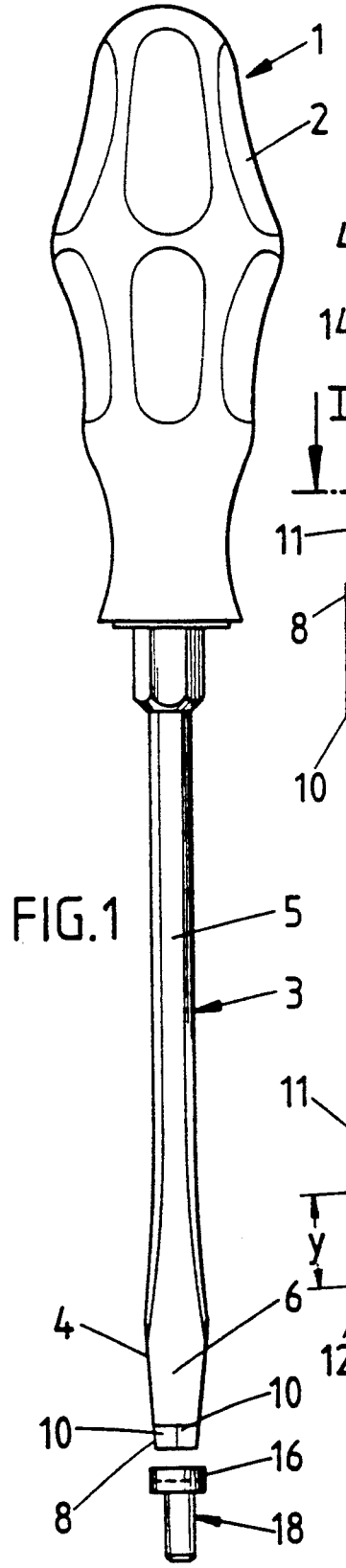
FIG. 1 is a view in elevation of a screwdriver in the case of the first embodiment.
Figure 2:
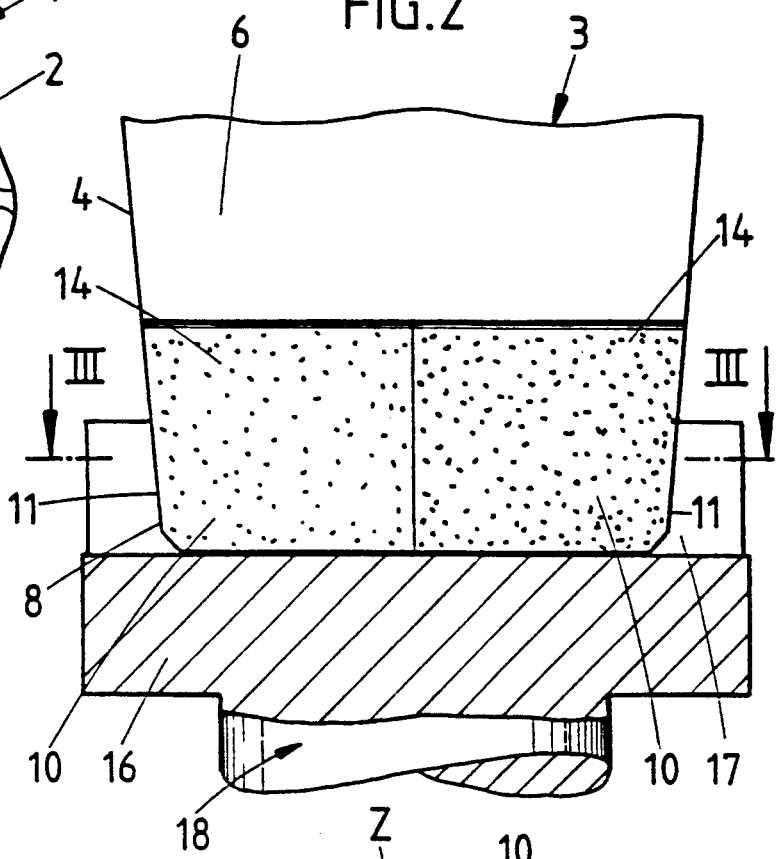
FIG. 2 shows, on a larger scale, a longitudinal section through the screw, passing through the screw slot with the working end of the blade of the screwdriver inserted into the screw slot.
Figure 3:
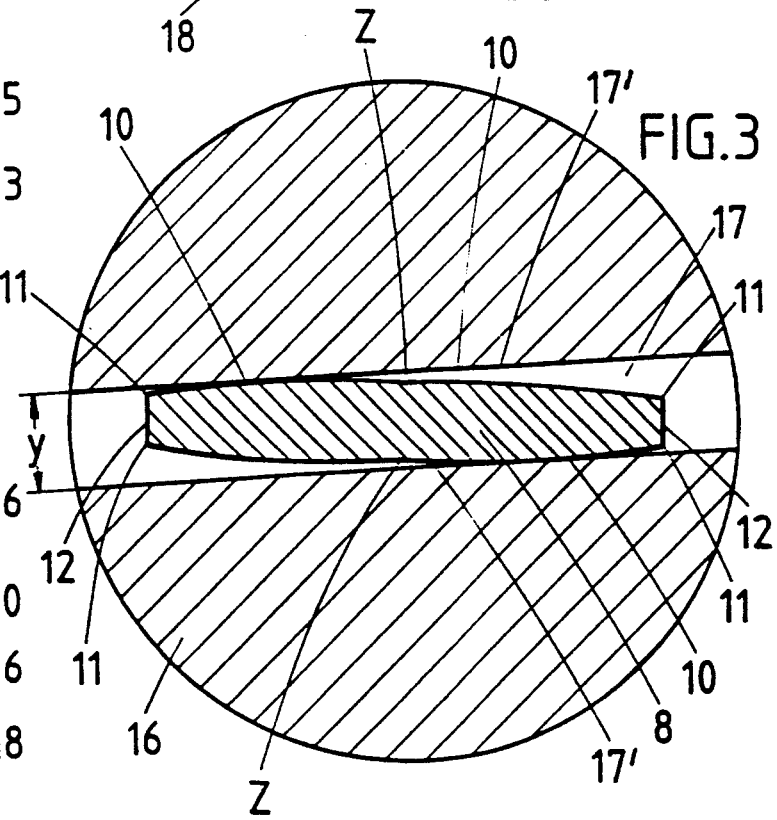
FIG. 3 is a section along the line III—III of FIG. 2.
Figure 5:
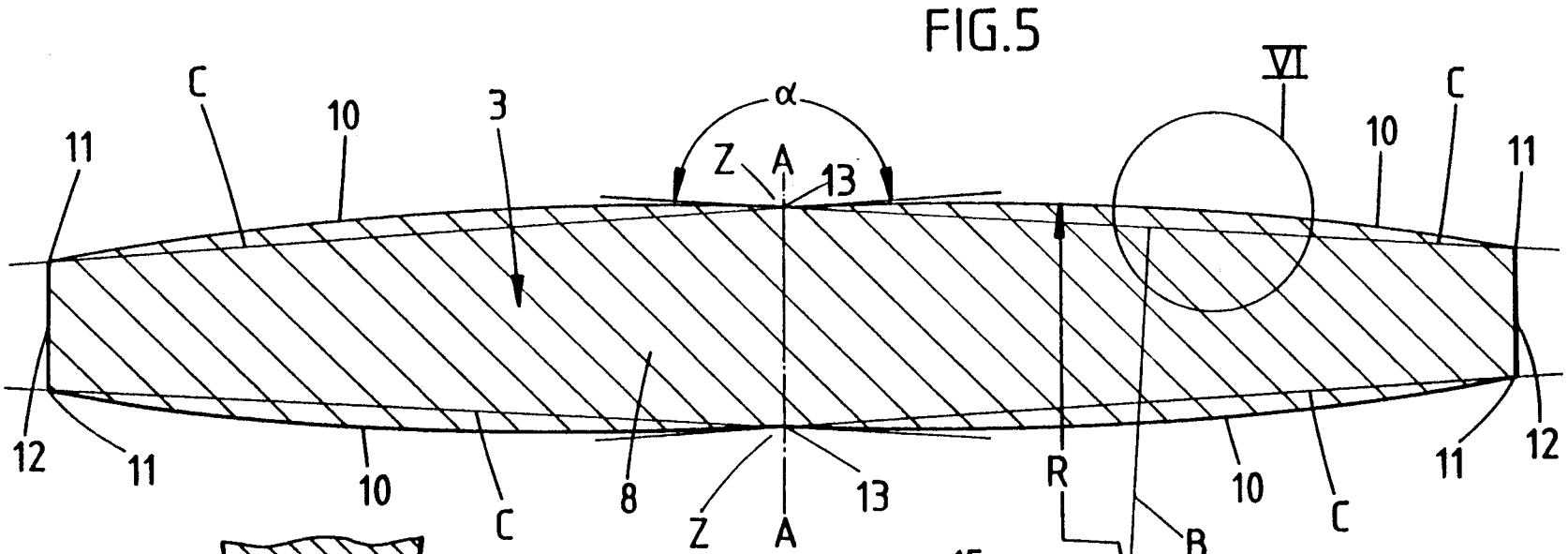
FIG. 5 shows a cross section, greatly enlarged, through the working end.

In FIGS. 1 to 6, which relate to the first embodiment, 1 refers as a whole to a slot screwdriver. It has a "power-grip" 2 with blade 3 extending from it. The screwdriver tip 4 which is at the free end of the blade 3 is suitable for slot screws.

The blade shank 5 has in detail a hexagonal cross section and is flattened on both sides in the region of the screwdriver tip 4. In this way, there are produced two conically tapering side surfaces 6 which, via approximately triangular recesses 7, form a parallel work end 8.

Each wide-side surface 9 of the work end 7 is convex. The convexity on each wide-side surface 9 is formed of two convex arcs 10 which adjoin each other. Each convex arc 10 commences at the corner 11 of the transverse side surface 12 of the working end 8 and terminates approximately at the transverse center plane A—A of the blade. In this way, the two convex arcs of each wide-side surface at a point Z on a transverse center plane A—A in an obtuse angle $\alpha$ which is slightly less than 180°; see FIG. 5.

The centers M of the convex arcs 10 are spaced laterally from the transverse center plane A—A of the blade. Each center M is located on the mid-perpendicular B of the straight line C which connects the corner edge 11 to the point of intersection 13 of the blade transverse center plane A—A with the wide-side surface 9. In this way, the four straight lines C form a rhombus the tips of which have been flattened by the transverse side surfaces 12. The convex arcs 10 lie above the rhombus surfaces or straight lines C.

Figure 6:
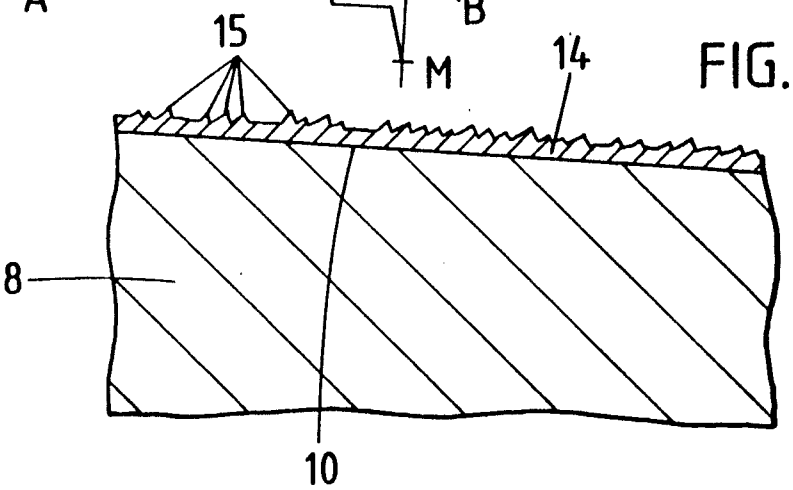
FIG. 6 shows in a further enlarged view, a portion VI of FIG. 5.
Figure 4:
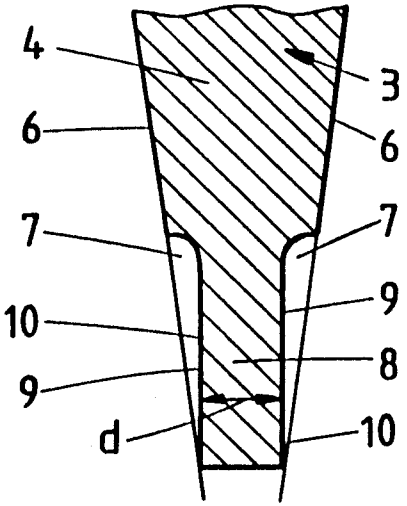
FIG. 4 shows, also on an enlarged scale, a longitudinal section through the blade in the region of the working end.

From FIG. 6 it can be noted that the convex surfaces 10 are provided with a coating 14 of diamond particles. This coating is obtained in the manner that a diamond powder of a particle size of about 15 $\mu$m is added to an electroplating bath into which the working end 8 dips. The protruding particle tips 15 accordingly result in a roughness of the surface of the convex arcs.

For the screwing or unscrewing of a screw 18 provided with a slot 17 on its screwhead 16, the working end 8 extends into the slot 17 of the screw 18. In order that this process can take place, the slot width y is, in accordance with existing standards, equal to or somewhat greater than the maximum thickness d of the working end, as seen in transverse direction. If the screwdriver 1 is now turned in clockwise direction in accordance with FIG. 3, this has the result that, starting from linear application of two diametrically opposite convex arcs 10, they pass, with due consideration of a certain elastic deformability of the screwhead 16, into a constantly increasing area application against the slot walls 17'. The corresponding two convex arcs 10 which lie diagonally opposite each other roll, so to speak, into the material of the screwhead or the slot wall 17', in which connection, at the same time, the tips 15 of the particles dig into the material and counteract the sliding of the working end 8 out of the screw slot 17. In this way, optimal forces can be transmitted in the relationship of the working end 8 to the screw 18 so that both a firm tightening of the screw as well as a loosening thereof is at all times assured.

The radius R of the convex arcs 10 is less than the radius of a convex arc extending over the entire surface of the wide side of the working end in accordance with the prior art.

Figure 7:
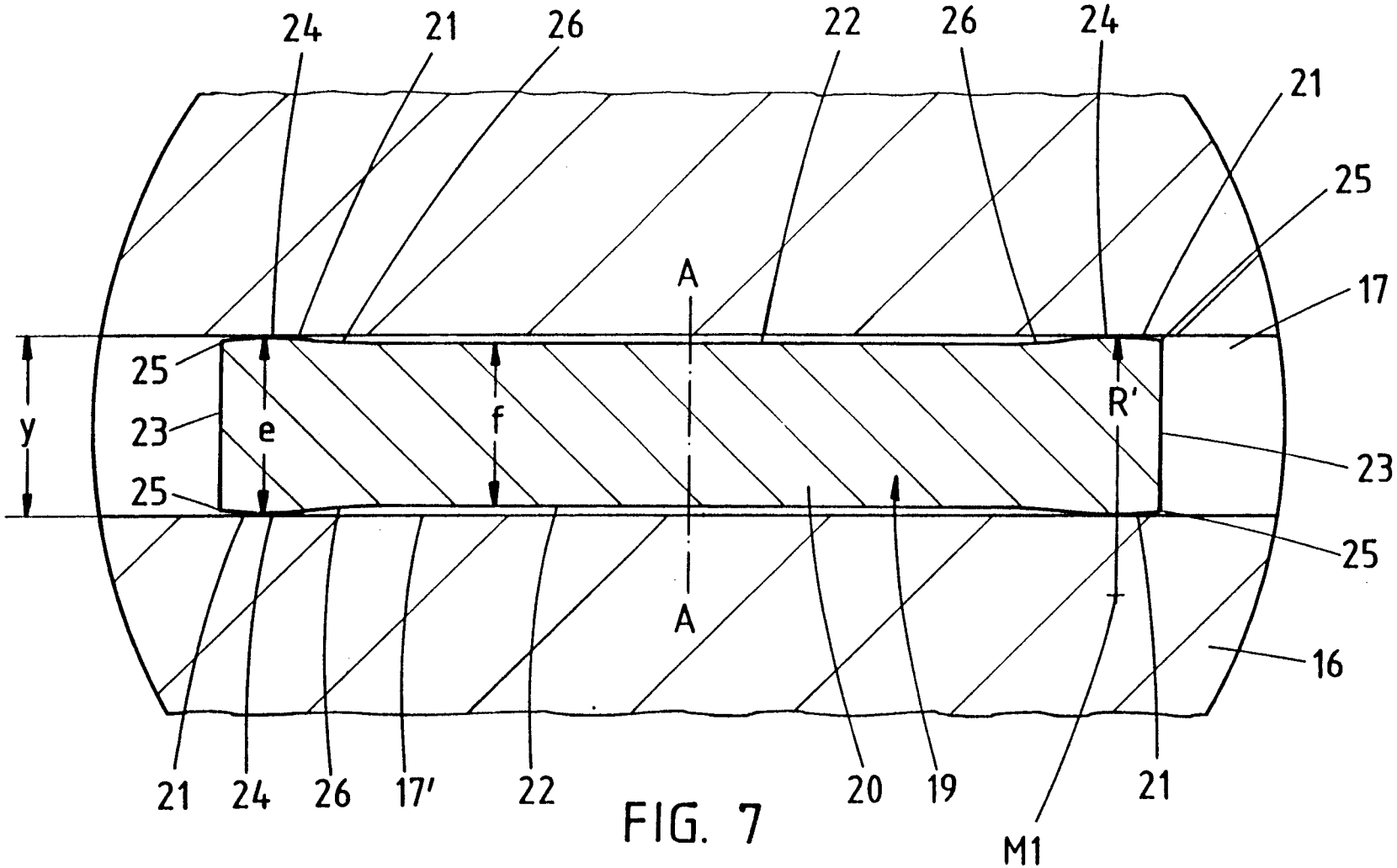
FIG. 7 shows, in greatly enlarged view, a cross section through the screwdriver blade in accordance with the second embodiment, the width of the blade corresponding to the width of the slot of the screw; and, FIG. 8 is a view corresponding to FIG. 7, but in which the screwdriver blade lies with movement play in the slot as a result of larger tolerances.
Figure 8:
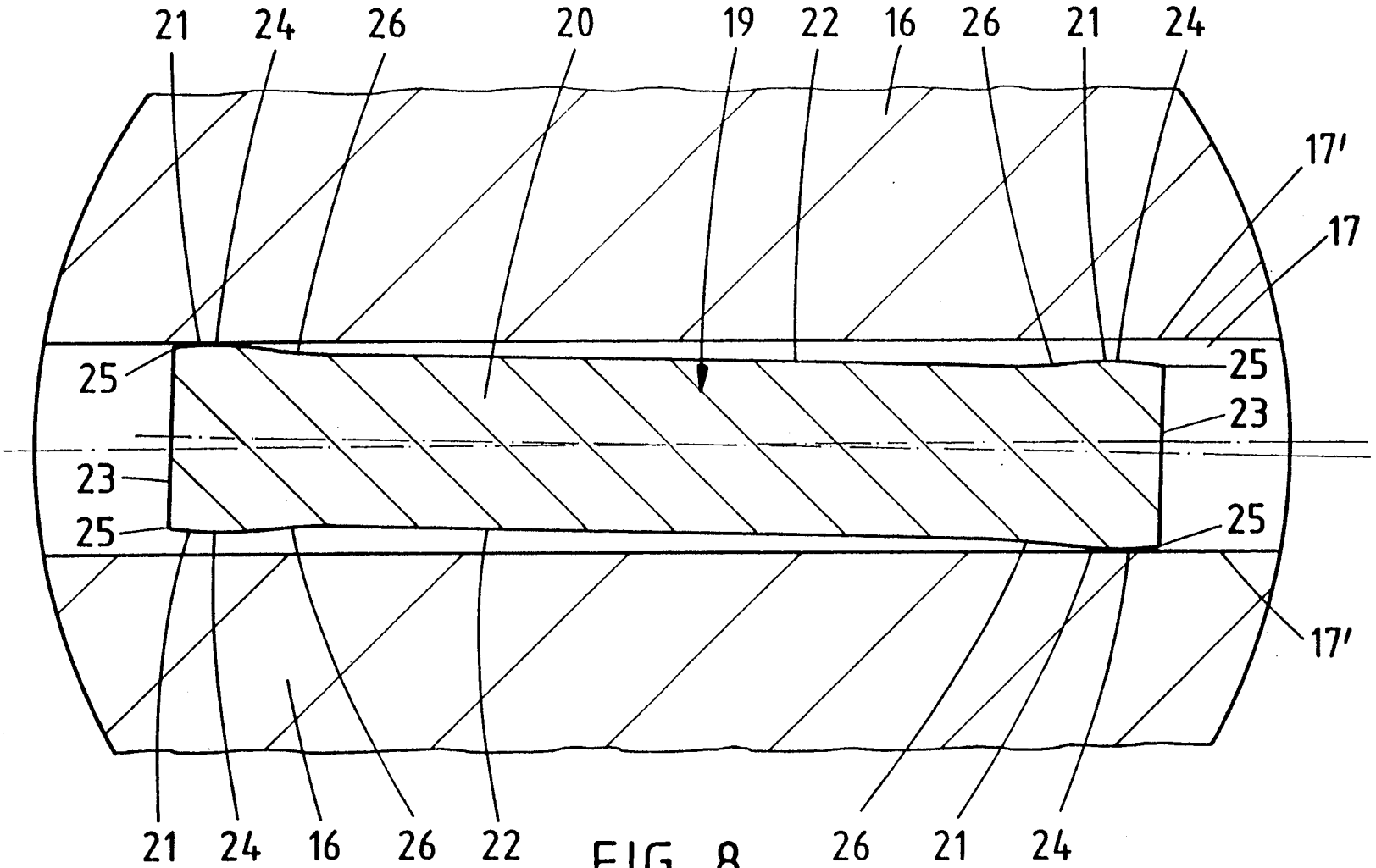

In the second embodiment, shown in FIGS. 7 and 8, the blade is designated by the number 19. Its working end 20 is so shaped that the convex arcs 21 which are arranged in each case on a wide-side surface of the blade are connected with each other by a valley 22 lying between them. As can be noted from FIGS. 7 and 8, the valley 10 has a greater length than the length of a convex arc 21. In the embodiment shown, the valley has about six times the length of a convex arc 21. The centers M1 of the convex arcs 21 are still further away from the transverse center plane A—A than in the first embodiment. However, they still extend within the region between the transverse side surfaces 23 of the working end 20. As a result thereof, the convex-arc curvature vertices 24 also lie at a distance from the transverse side surfaces 23. This means that each convex arc 21 descends on the other side of the convex-arc curvature vertices 24 in the direction towards the transverse-side surface 23 and forms a corner edge 25 with the latter there.

In order to avoid a notch effect, the center-side end of each convex arc 21 passes, via a concave arc 26, into the flat bottom of the valley 22. The width f of the cross section of the blade 19 in the region of the valley 22 is about 8% less than the width e in the region of the convex-arc curvature vertices 24.

From FIG. 7 it can be noted that the slot width y of the screwhead 16 corresponds approximately to the width e in the region of the convex-arc curvature vertices 24. Upon rotation of the screwdriver blade 19 around its longitudinal axis, flat application between convex arcs 21 and slot wall 17', takes place, in contradistinction to the first embodiment, further outside the longitudinal axis so that an improved transmission of torque is furthermore obtained here.

Even if play should occur as a result of larger tolerances between working end 20 and slot 17, as shown in FIG. 8, partial surface application takes place between convex arcs 21 and slot wall 17' upon rotary driving, it becoming larger with greater torque due to the elastic deformability of the screwhead 16.

I claim:

1. A slot screwdriver comprising a blade having a working end with opposed convex broad-side surfaces on the working end bounded by opposed relatively narrow transverse-side surfaces, each of the broad-side surfaces having two convex arcs with apices of their curvature lying in a region between the transverse-side surfaces, the apices being located symmetrically on both sides of a transverse central plane disposed equidistant from the transverse-side surfaces;

wherein the blade has a thickness at the working end, the thickness decreasing with progression from the apices towards the adjacent transverse-side surfaces; and regions of the working end which contain the apices of the convex arcs have a greater thickness than a region of the working end at the transverse central plane.

2. A slot screwdriver according to claim 1, wherein said convex arcs on each of said broad-side surfaces meet in an obtuse angle on the transverse central plane.

3. A slot screwdriver according to claim 1, wherein centers of the convex arcs lie displaced from the transverse central plane of the blade.

4. A slot screwdriver according to claim 1, wherein the screwdriver blade is flattened with a conical tapering of the broad-side surfaces and with recesses in the broad-side surfaces to provide a parallel sided configuration to the working end with the convex arcs on its broad-side surfaces.

5. A slot screwdriver according to claim 1, wherein surfaces bounded by the convex arcs are provided with a coating of diamond particles.

6. A slot screwdriver according to claim 1, wherein each broad-side surface has a depression in the form of a valley disposed centrally between two of the convex arcs arranged on a broad side of the blade, the valley having a greater length than a length of either convex arc.

7. A slot screwdriver according to claim 6, wherein the length of the valley is several times the length of either convex arc.

8. A slot screwdriver according to claim 6, wherein the two convex arcs of a broad-side surface are spaced apart and the depression has a flat bottom; and a centrally located end of each of the convex arcs of a broad-side surface passes via a further convex arc tangentially into the flat bottom of the depression.

9. A slot screwdriver according to claim 6, wherein a width of a cross section of the blade is about 8% smaller in a region between opposed ones of the valleys than in a region between apices of opposed ones of the convex arcs.

10. A screwdriver for use with a slotted screw, comprising a shank and a blade disposed at an end of the shank, a working end of the blade having a generally rectangular cross-section bounded by a pair of opposed broad-side surfaces and a pair of end-side surfaces narrower than said broad-side surfaces, wherein each of said broad-side surfaces has an undulation comprising two peak regions and one depression disposed between said two peak regions, said peak regions being engageable with the slot of a slotted screw upon a rotation of the screw by the screwdriver.

* * * * *